US005493781A

United States Patent [19]

Saito

[11] Patent Number: 5,493,781

[45] Date of Patent: Feb. 27, 1996

[54] CUTTER

[75] Inventor: Tatsuya Saito, Seki, Japan

[73] Assignee: Kai R&D Center Co., Ltd., Gifu, Japan

[21] Appl. No.: 141,193

[22] Filed: Oct. 21, 1993

Related U.S. Application Data

[63] Continuation-in-part of Ser. No. 922,064, Jul. 29, 1992, abandoned.

[30] Foreign Application Priority Data

Apr. 17, 1992 [JP] Japan ..... 4-98187

[51] Int. Cl.[6] ..... B26B 25/00; B26B 29/02

[52] U.S. Cl. ..... 30/162; 30/164.95; 30/292; 30/314; 30/319; 30/335

[58] Field of Search ..... 30/162, 292, 307, 30/319, 320, 335, 314, 315, 317, 340

[56] References Cited

U.S. PATENT DOCUMENTS

| | | | |
|---|---|---|---|
| 1,306,783 | 6/1919 | Smolonsky | 30/307 X |
| 1,534,576 | 4/1925 | Edgren | 30/292 |
| 1,906,573 | 5/1933 | Gits | 30/320 |
| 3,863,339 | 2/1975 | Reaney et al. | 30/320 X |
| 4,301,594 | 11/1981 | Okada | 30/292 X |
| 4,432,137 | 2/1984 | Okada | 30/292 |
| 4,558,517 | 12/1985 | Gringer | 30/162 X |
| 4,601,103 | 7/1986 | Sugiyama | 30/292 X |
| 4,621,425 | 11/1986 | Stoutenberg | 30/162 |
| 4,794,693 | 1/1989 | Mayama et al. | 30/162 |
| 4,803,782 | 2/1989 | Lok | 30/162 X |
| 4,884,342 | 12/1989 | McNamara et al. | 30/162 |
| 5,054,198 | 10/1991 | Gmoch | 30/335 X |
| 5,101,564 | 4/1992 | Melter | 30/307 X |

FOREIGN PATENT DOCUMENTS

| | | | |
|---|---|---|---|
| 0027492 | 9/1983 | European Pat. Off. . | |
| 2440849 | 4/1975 | Germany | 30/320 |

*Primary Examiner*—Rinaldi I. Rada
*Assistant Examiner*—Clark F. Dexter
*Attorney, Agent, or Firm*—Limbach & Limbach; W. Patrick Bengtsson

[57] ABSTRACT

A cutter includes a movable blade, a handle and a slider. The movement of the slider causes the blade to move between an extended cutting position and a retracted storage position. The slider includes one projection which is pressed against a surface of the blade so as to frictionally engage the blade for preventing its free rotation or movement during the cutting operation.

6 Claims, 6 Drawing Sheets

CUTTER

This is a continuation-in-part of U.S. patent application Ser. No. 07/922,064 filed on Jul. 29, 1992,now abandoned which is incorporated herein by reference.

BACKGROUND OF THE INVENTION

1. Field of the Invention

The present invention generally relates to a cutter. More particularly, it relates to a cutter haying a blade which is slidably extendable to a protracted cutting position and a retracted storage position.

2. Description of the Prior Art

The following conventional cutters are well known and exemplify the state of the art in the field. A rotary cutter has a disc shaped blade which rotatably and pivotally moves with respect to a stationary handle. A conventional cutter knife has a straight cutting edge. The cutting edge slidably protrudes to permit cutting and is retracted for storage.

The rotary cutter allows the rotational friction force to be adjusted, in order to improve the performance of the cutter. The U.S. Pat. No. 4,301,594 discloses one type of rotary cutter. The cutter has a slider arranged at one end section of a handle. A disc shaped blade is secured to the slider by means of a fastening device, at its center section. Consequently, an appropriate rotational friction force could be applied to the disc blade so as to prevent a free, arbitrary rotation of the disc blade during the cutting operation.

However, when the fastening device is excessively tightened, the rotational friction force is significantly increased. Consequently, the disc blade becomes hard to rotate. When the fastening device becomes loose, the rotational friction force is significantly decreased so that the disc blade starts to freely rotate. As a result, the adjustment of the fastening device becomes rather difficult. If the adjustment is improperly made, the cutting ability of the cutter decreases.

The Japanese Unexamined Utility Model Publication No. 61-54752 discloses a cutter knife which has a straight cutting edge. The cutter knife has a pair of grooves within its handle. The grooves communicate with an outer peripheral end of the elongated handle. One of distal ends of the handle is opened. When a slider is moved along the grooves, the blade is caused to slide by the slider so that the cutting edge of the blade protrudes beyond the distal end of the handle, through the opening in the distal end of the handle.

When the blade is extended by the slider and touches the inner wall of the opening, the sliding ability of the blade significantly decreases. Therefore, it is necessary to create a relatively small gap between the inner wall of the opening and the blade. Consequently, the blade that cannot be securely held in position creates a swaying motion during the cutting operation. As a result, the cutting ability of the blade decreases.

SUMMARY OF THE INVENTION

It is therefore a object of the present invention to provide a cutter with a rotatable and slidable blade and a slider, for stable handling.

Another object of the present invention is to provide a cutter having a rotatable and slidable blade, such that the blade is securely supported during the cutting operation in order to increase the cutting ability of the cutter.

To achieve the foregoing and other objects there is provided a cutter which includes a handle and a disc blade. The blade can be protracted or retracted. A slider is connected to the blade and slidably supports the handle, and permits the blade to move between a cutting position and a storage position. A pressure applying device includes a cantilevered elastic projection formed on the slider to abut against the blade. The cantilevered projection abuts against the blade when the blade is in use.

In one aspect of the present invention, a disc blade is rotatably attached to the distal end of the handle. The distal end has a disc shape, generally proportioned to the disc blade. When the disc blade is extended to the forward cutting position, the cantilevered projection abuts against the inner surface of the disc blade and applies a rotational friction force to the disc blade.

In another aspect of the present invention, a blade which has a straight cutting edge that can be extended into a cutting position beyond the distal end of the handle. The cutting edge is retractable within the handle, for storage, when the cutter is not in use. The blade is pushed against the inner peripheral edge of the opening by means of the cantilevered projection, in order to avert the undesirable sway of the blade.

DESCRIPTION OF THE PREFERRED EMBODIMENT

A preferred first embodiment of a rotary cutter according to the present invention, will now be described with reference to FIGS. 1 through 10.

Figure 1:
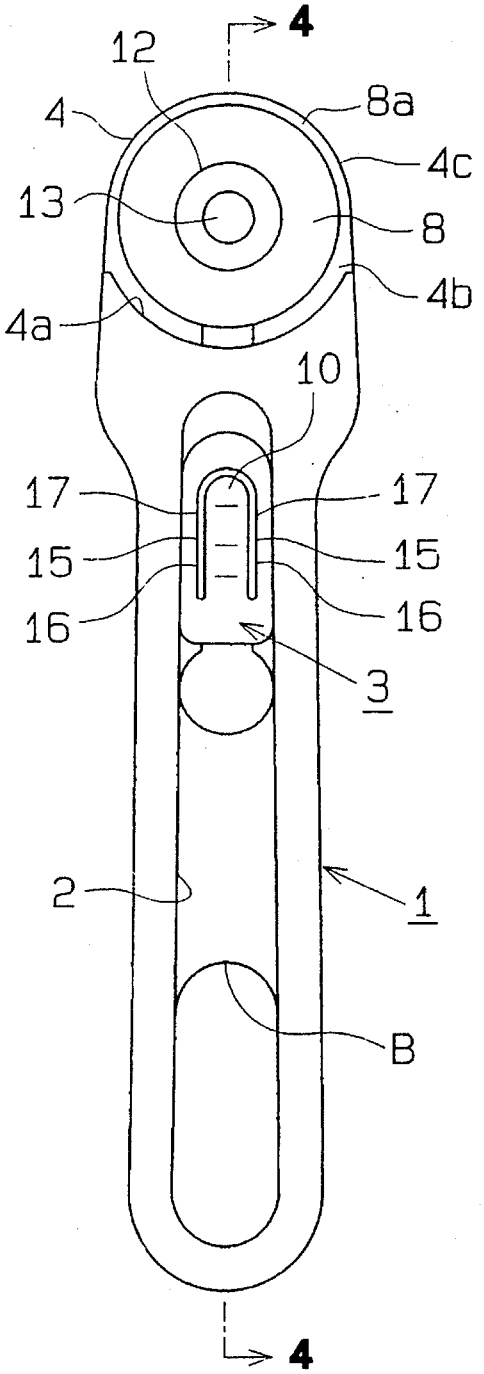
FIG. 1 is a plan view of a rotary disc blade cutter, showing the blade retracted according to a first embodiment of the present invention.
Figure 2:
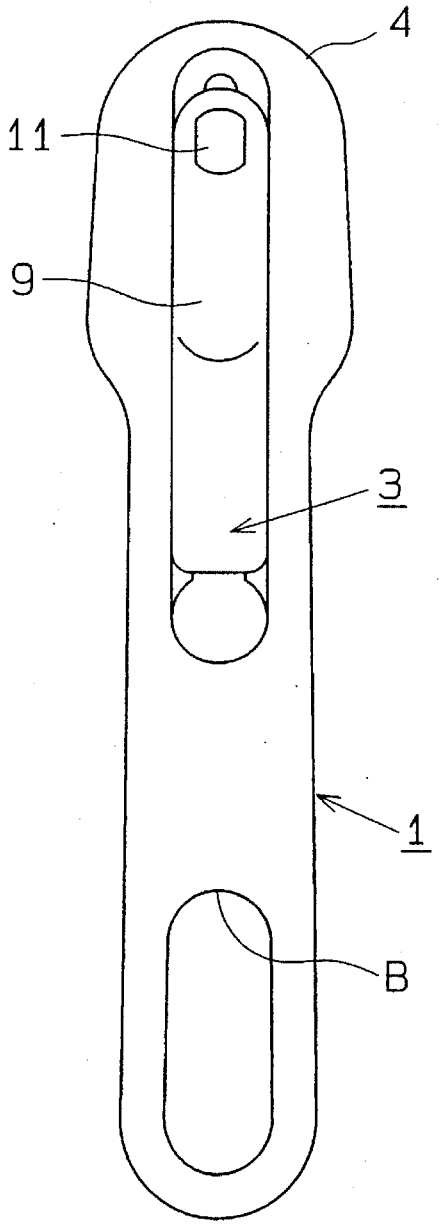
FIG. 2 is a near plan view of the cutter of FIG. 1.

As illustrated in FIG. 1, the cutter includes a generally elongated handle which is made of synthetic resin. An elongated groove 2 guides a slider 3 along the front surface of the handle 1. An aperture B is formed in the handle 1, for hooking the cutter when it is not in use. When the slider 3 is manually slid, the slider 3 is guided by the inner peripheral edge of the groove 2 along length of the handle 1.

Figure 3:
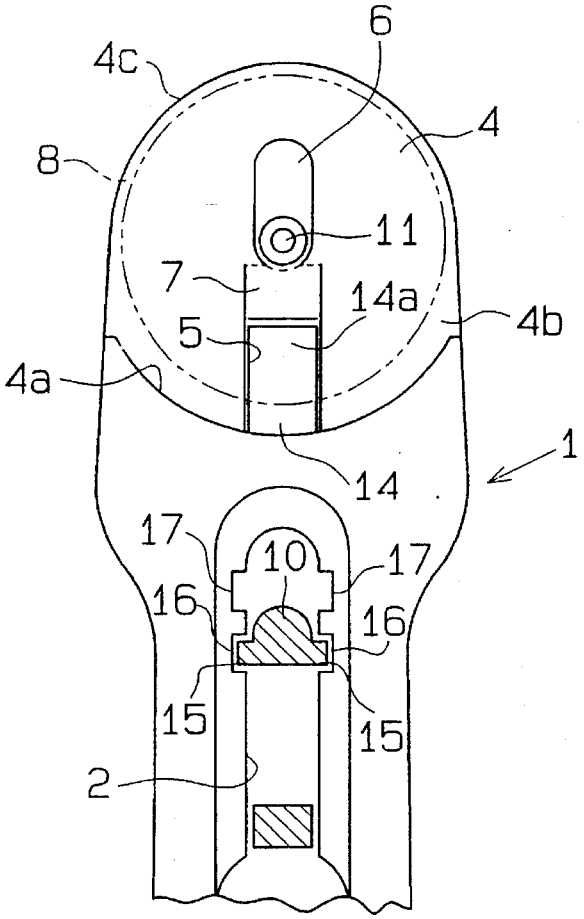
FIG. 3 is an enlarged partially broken plan view of the rotary disc blade of FIG. 1, illustrating a slider in engagement with a handle.

The distal end of the handle 1 includes an enlarged platform 4 which supports a disc blade 8. The platform 4 has a rear generally flat surface. One surface of the platform 4 is designated as an upper surface 4*b*, and engages the disc blade. As shown in FIG. 3, the upper surface 4*b* has a slot 5 and a bore 6. The slot 5 and the bore 6 are adjacent to each other, and are located along the sliding direction of the sliders 3. The bore 6 is positioned closer to the peripheral edge of the platform 4. A relatively inclined tongue 7 is formed at the distal end of the slot 5. The distal end of the tongue 7 is more inclined than its proximal end, and is closer to the upper surface 4*b*.

Figure 5:
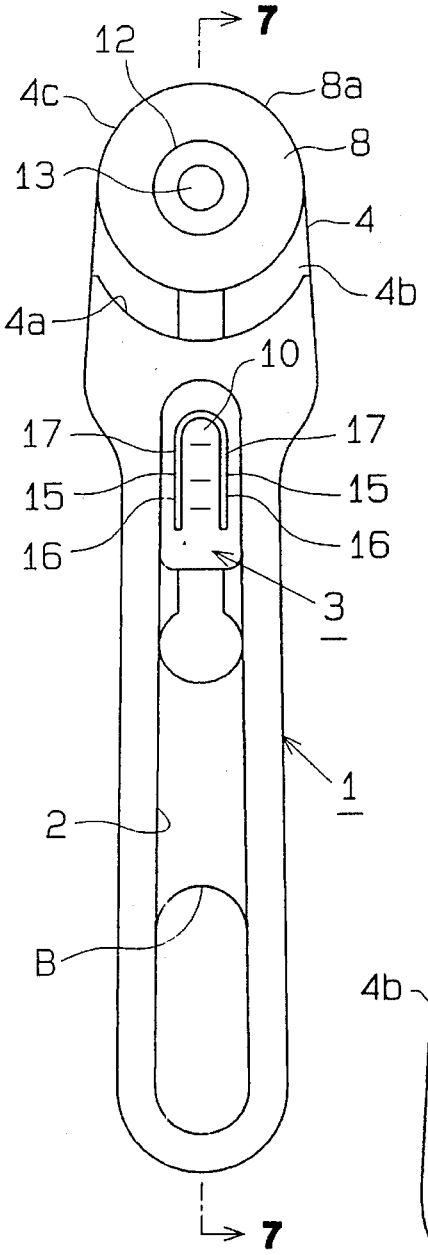
FIG. 5 is a side view of the cutter showing the blade in a protracted position.
Figure 7A:
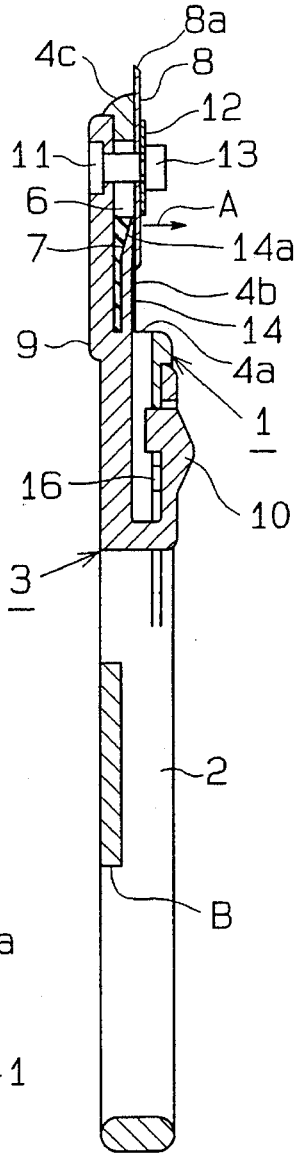
FIG. 7*a* is a cross-sectional view of the cutter taken along line VII—VII in FIG. 5.
Figure 6:
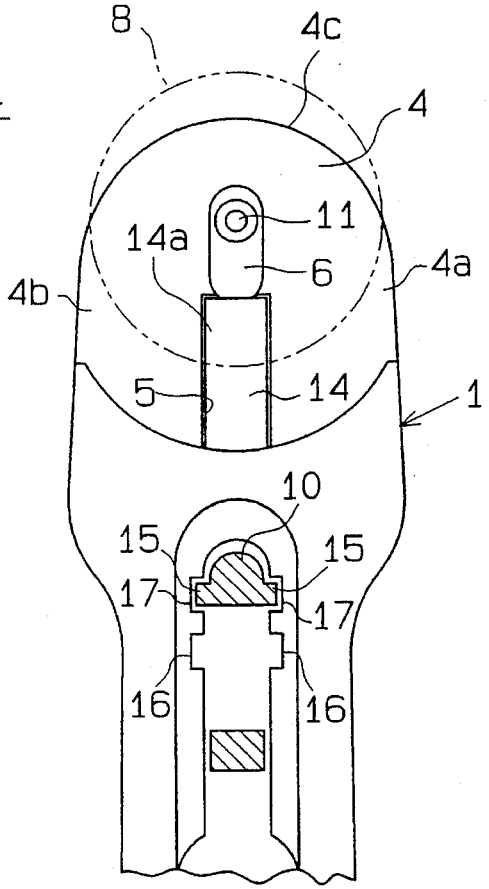
FIG. 6 is a partially broken plan view of the cutter of FIG. 5.

The disc blade 8 is rotatably supported on the upper surface 4*b*, and has an orbicular peripheral cutting edge 8*a*. When the cutter is not in use, the disc blade 8 is retracted so that the cutting edge 8*a* is securely held within an arc shaped peripheral edge 4*c* of the platform 4. As shown in FIGS. 5 through 7, when the cutter is in use, a portion of the cutting edge 8*a* is caused to protrude beyond the peripheral edge 4*c* by the slider 3.

Figure 4A:
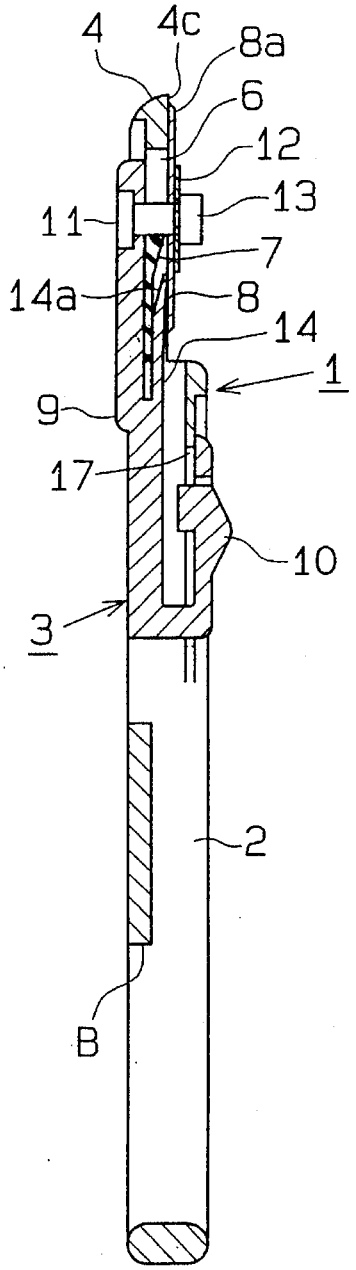
FIG. 4*a* is a cross-sectional view of the cutter taken along line IV—IV in FIG. 1.
Figure 4B:
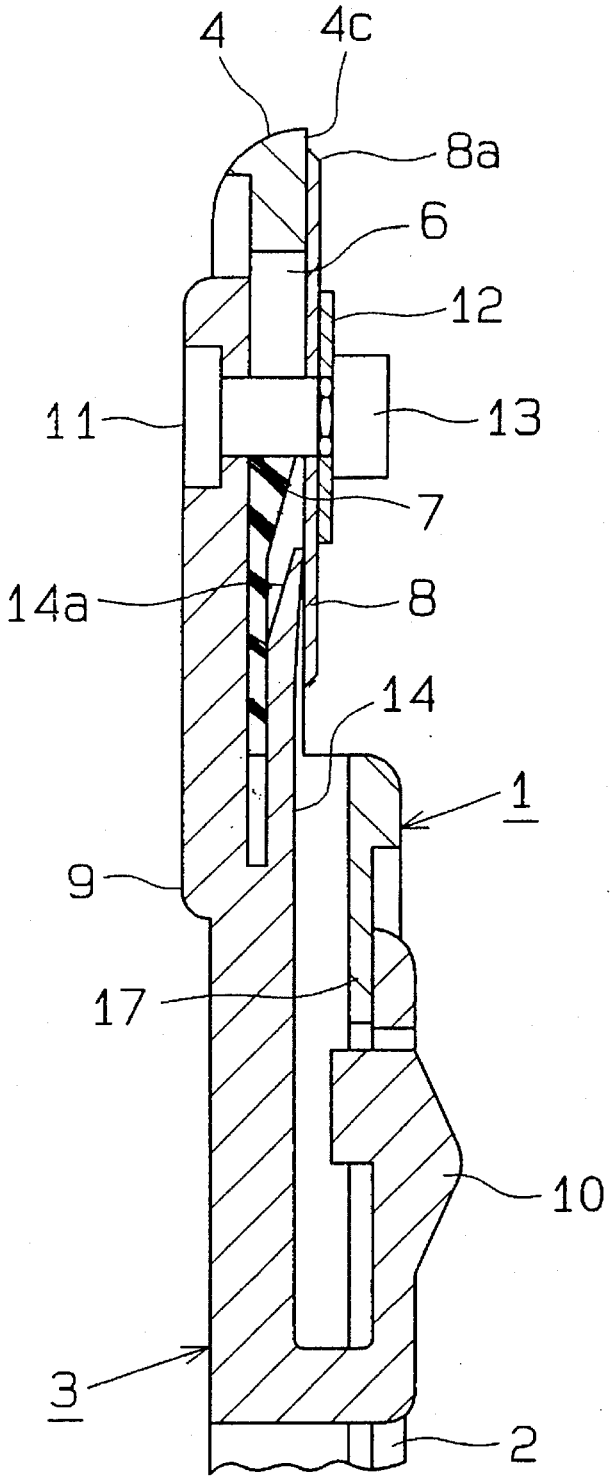
FIG. 4*b* is an enlarged fragmentary view of FIG. 4*a;*

The slider 3 is made of a synthetic resin. As shown in FIG. 4*a*, the slider 3 is integrally formed with a generally thin rectangularly shaped base 9, and a generally short finger grip 10. The base 9 is disposed on the rear surface of the platform 4 with the slider 3 placed in the groove 2. The finger grip 10 is easily accessible by the user. When the finger grip 10 is pressed, it is bent toward the rear surface direction. When the pressure is released, the elastic finger grip 10 returns to its original position.

A nut 11 engages the base 9, and is securely fastened to the central section of the disc blade 8, through the bore 6 of the platform 4. A spring washer 12 is mounted on the upper surface of the disc blade 8. A threaded bolt 13 is inserted in the spring washer 12, and the disc blade 8 is coupled to the nut 11. Therefore, the disc blade 8 is securely fastened against the upper surface 4*b* by the spring washer 12. The disc blade 8 may rotate steadily around the axis of the nut 11.

A cantilevered elastic projection 14 extends from the base 9 of the slider 3, and projects outwardly toward the distal end of the disc blade 8. It is inserted into the slot 5 of the platform 4, and is disposed within the inner side of the disc blade 8. A tip 14*a* is used to apply pressure to the blade 8, is formed at the distal end of the cantilevered projection 14, and engages the tongue 7.

As shown in FIG. 3, the finger grip 10 includes a pair of projections 15 for positioning the blade 8. A pair of recesses 16 and 17 engage the projections 15 for locking the blade into position.

As shown in FIGS. 1 through 4, when the cutter is not in use, the projections 15 of the finger grip 10 are inserted in the first recess 16, so that the orbicular peripheral cutting edge 8*a* of the disc blade 8 is retracted and is securely held within the arc shaped peripheral edge 4*c* of the platform 4. As shown in FIG. 4*b*, the tip 14*a* of the slider 3 is then disengaged from the tongue 7. Therefore, the tip 14*a* does not contact the disc blade 8.

When the cutter is in use, the finger grip 10 of the slider 3 is pushed forward so as to disengage the projections 15 from the first recess 16. As shown in FIGS. 5 through 7, when the finger grip 10 is slid toward the platform 4 and the finger grip 10 is released, the finger grip 10 returns to its original shape. Consequently, the projections 15 engage the second recess 17. The nut 11 and the threaded bolt 13 together with the base 9 of the slider 3 are moved toward the platform 4 along the bore 6, so that the orbicular peripheral cutting edge 8*a* of the disc blade 8 protrudes beyond the peripheral edge 4*c*.

Figure 7B:
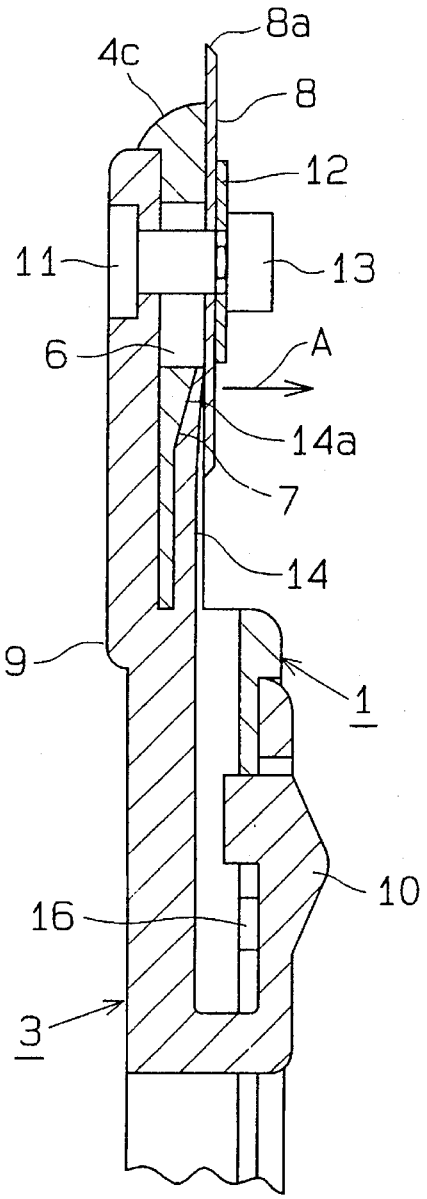
FIG. 7*b* is an enlarged fragmentary view of FIG. 7*a;*

As illustrated in FIG. 7*b*, when. cantilevered projection 14 of the slider 3 moves toward the distal end of the platform 4, the tip 14*a* contacts the tongue 7. Therefore, the tip 14*a* contacts the disc blade 8. The tip 14*a* applies frictional pressure to the disc blade 8 in the direction indicated by the arrow A, as shown in FIG. 7*b*. As a result, the frictional force applied to the disc blade 8 is significantly increased when the disc blade 8 rotates.

When the cutter is in use, the finger grip 10 of the slider 3 is moved toward the distal end of the platform 4, as previously described. Therefore, the orbicular peripheral cutting edge 8*a* of the disc blade 8 protrudes beyond the peripheral edge 4*c*. The blade 8 is pressed against the material to be cut, and pressure is applied to the handle 1 for causing the blade 8 to cut through the material. The cutting edge 8*a* of the disc blade 8 is kept protruded beyond the peripheral edge 4*c* of the platform 4, when the disc blade 8 is pressed on the material.

According to the first embodiment of the present invention, the cantilevered elastic projection 14 is arranged on the slider 3. When the cutter is in use, the cantilevered elastic projection 14 presses against the disc blade 8. Therefore, the appropriate rotational friction force can be applied to the disc blade 8 by means of the slider 3, without the use of a new part.

Figure 8:
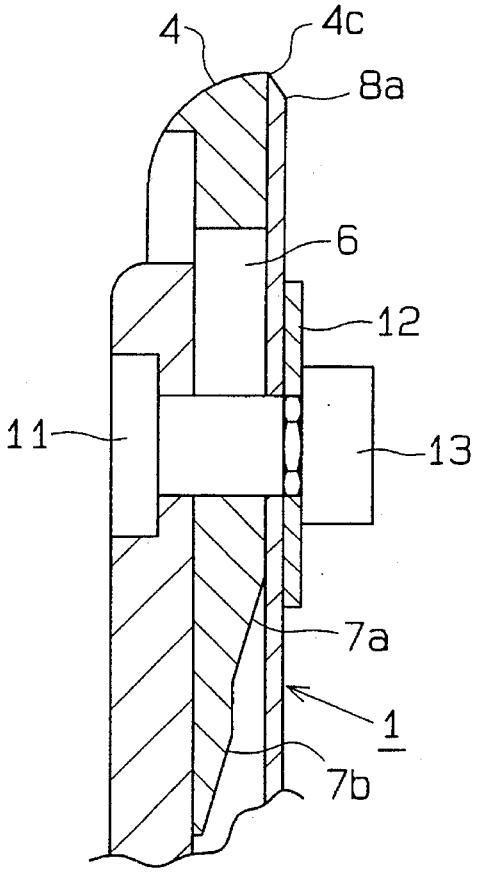
FIG. 8 is a cross-sectional view showing a modification of the first embodiment.

FIG. 8 illustrates a modification having two tapered surfaces 7*a*, 7*b*. This enables the cutting edge 8*a* of the blade to selectively protrude beyond the platform 4 to two cutting positions. Accordingly, the protruding amount of the cutting edge 8*a* from the platform 4 may be adjusted in accordance with the thickness and/or nature of the material.

Figure 9:
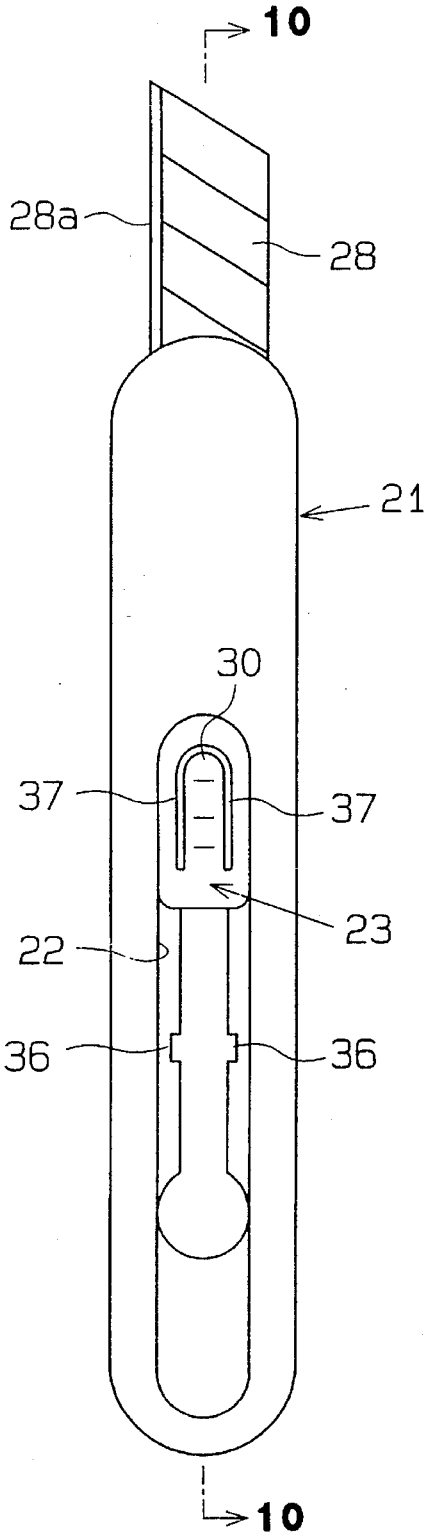
FIG. 9 is a side view of a cutter having a straight cutting edge shown protracted according to a second embodiment of the present invention.
Figure 10:
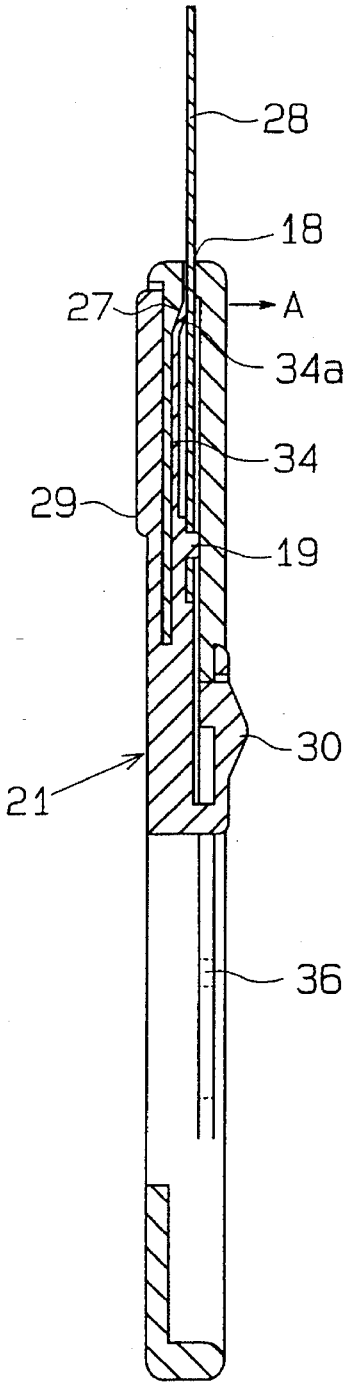
FIG. 10 is a cross-sectional side view taken along line X—X in FIG. 9.

A second embodiment of the cutter according to the present invention will now be described with reference to FIGS. 9 and 10, with specific focus on the differences between the two embodiments.

A blade 28 has a straight cutting edge 28*a*. An opening 18 is arranged at the distal end of a handle 21. The opening 18 communicates with a groove 22. The blade 28 is inserted into the handle 21 through the opening 18. A projection 19 is arranged on a base 29 of a slider 23. The base section of the blade 28 is inserted into the projection 19. Therefore, the slider 23 and the blade 28 can be integrally moved.

The operation of the cutter will now be described. The slider 23 is moved toward the distal end by means of a finger grip 30, so that the blade 28, which is retracted into the groove 22 of the handle 21, is caused to protrude beyond the opening 18. The distance traveled by the slider 23 controls the length of the blade 28 protruding beyond the handle 21, or retracted therein.

When the cutter is in use, a tip 34*a* of a cantilevered elastic projection 34 of the slider 23 is pressed by a tongue 27. The tongue 27 is pressed against the blade 28 at an inner surface of the opening 18 of the handle 21. As a result, the blade 28 is pressed against the inner surface of the opening 18, so that the sway of the blade 28 is significantly reduced.

The present invention can be used in conjunction with a plurality of blades with various shapes, other than those described in the present specification.

Although only two embodiments of the present invention have been described, it should become apparent to those skilled in the art that the present invention may be embodied in many other specific forms without departing form the scope of the invention.

What is claimed is:

1. A cutter comprising:

a handle including an elongated groove;

a blade having a first surface and a second surface, said first surface facing said handle, said blade being movable between a cutting position and a storage position;

slider means, connected to said blade and slidably supported by said handle and along said elongated groove, for selectively moving said blade between said cutting and storage positions and for holding said blade in said cutting and said storage positions;

said slider means including resisting means for frictionally resisting a free movement of said blade during a cutting operation, a base portion that is generally positioned in proximity of said first surface of said blade, and a positioning portion which extends from said base portion for securely positioning the blade in one of said positions;

said handle including pressing means for pressing said resisting means against said first surface of said blade when said blade is in said cutting position;

said resisting means including a resilient member which projects from the base portion toward said first surface of the blade and positioned such that said resilient member is forced toward said first surface of the blade when said blade is moved from said storage position to said cutting position;

wherein said blade has a generally disc shape and is rotatably mounted on said slider means, and wherein said handle includes a platform extended from an end of said handle and supporting the blade for rotation thereon.

2. A cutter according to claim 1, wherein said pressing means includes a plurality of tapered surfaces.

3. A moveable blade cutter comprising:

a handle;

a blade having a first surface and a second surface, the first surface facing the handle, said blade being movable between a cutting position and a storage position;

said handle including an elongated groove;

slider means being slidably movable within said elongated groove and connected to said blade, and slidably supported by said handle, for switching the blade position between the cutting position and the storage position;

said slider means including resisting means for frictionally resisting a free movement of the blade during a cutting operation;

said handle including pressing means for pressing the resisting means against said first surface of the blade in the cutting position; and a platform extending from an end of the handle, wherein the blade is rotatably mounted on said slider means and is supported by said platform for rotation thereon.

4. A cutter according to claim 3, wherein said slider means includes a base portion that is generally positioned in proximity of the first surface of said blade, and a positioning portion which extends from the base portion for securely positioning the blade in one of said positions.

5. A cutter according to claim 4, wherein said elongated groove includes a plurality of setting recesses, and wherein said positioning portion includes a plurality of projections which engage said setting recesses for causing said blade to be securely retained in one of said positions.

6. A movable blade cutter comprising:

a handle;

a blade having a first surface and a second surface, the first surface facing the handle, said blade being movable between a cutting position and a storage position;

slider means, connected to said blade and slidably supported by said handle, for switching said blade between said cutting position and said storage position;

said slider means including a base portion being generally positioned in proximity of said first surface of said blade, and a positioning portion extending from said base portion for securely positioning said blade in one of said positions;

said handle including an elongated groove, and said slider means being slidably movable within said elongated groove;

said elongated groove including a plurality of setting recesses, and said slider means including a plurality of projections engaging said setting recesses for causing said blade to be securely retained in one of said, positions;

said slider means including resisting means for frictionally resisting a free movement of said blade during a cutting operation;

said resisting means including a resilient member for abutting said first surface when said blade is in said cutting position;

said handle including at least one tapered surface positioned adjacent said blade such that said resilient member contacts said tapered surface and is forced toward said blade when said blade is switched from said storage position to said cutting position;

wherein said blade has a generally disc shape and is rotatably mounted on said slider means, and wherein said handle further includes a platform extending from an end of said handle and supporting the blade for rotation thereon.

* * * * *